US008743154B2

(12) United States Patent
Wang

(10) Patent No.: US 8,743,154 B2
(45) Date of Patent: Jun. 3, 2014

(54) SOURCE DRIVER AND ELECTRONIC SYSTEM UTILIZING THE SAME

(75) Inventor: Shou-Cheng Wang, Zhubei (TW)

(73) Assignee: Chimei Innolux Corporation, Miao-Li County (TW)

( * ) Notice: Subject to any disclaimer, the term of this patent is extended or adjusted under 35 U.S.C. 154(b) by 903 days.

(21) Appl. No.: 12/725,588

(22) Filed: Mar. 17, 2010

(65) Prior Publication Data

US 2010/0245403 A1 Sep. 30, 2010

(30) Foreign Application Priority Data

Mar. 30, 2009 (TW) ..... 98110375 A

(51) Int. Cl.
*G09G 5/10* (2006.01)
*G09G 3/20* (2006.01)
*G09G 3/32* (2006.01)

(52) U.S. Cl.
CPC ..... *G09G 3/2003* (2013.01); *G09G 2320/0626* (2013.01); *G09G 3/3266* (2013.01)
USPC ..... 345/690; 345/211

(58) Field of Classification Search
CPC ..... G09G 3/2003; G09G 2320/0626; G09G 3/3266
USPC ..... 345/77, 204, 211, 690, 82; 315/169.3
See application file for complete search history.

(56) References Cited

U.S. PATENT DOCUMENTS

| | | | | |
|---|---|---|---|---|
| 5,563,666 | A * | 10/1996 | Suzuki | 348/645 |
| 6,956,547 | B2 * | 10/2005 | Bae et al. | 345/77 |
| 7,113,207 | B2 * | 9/2006 | Fukui et al. | 348/225.1 |
| 2005/0123206 | A1 * | 6/2005 | Sakai et al. | 382/238 |
| 2006/0145981 | A1 * | 7/2006 | Lee et al. | 345/89 |
| 2007/0047808 | A1 * | 3/2007 | Choe et al. | 382/169 |
| 2008/0186263 | A1 * | 8/2008 | Lee | 345/82 |
| 2008/0218456 | A1 * | 9/2008 | Park et al. | 345/77 |

FOREIGN PATENT DOCUMENTS

WO WO 2008/143134 11/2008

OTHER PUBLICATIONS

Chinese language office action dated Mar. 28, 2013.

* cited by examiner

*Primary Examiner* — Pegeman Karimi
(74) *Attorney, Agent, or Firm* — McClure, Qualey & Rodack, LLP

(57) ABSTRACT

A source driver providing an output image to a plurality of pixels and including a judgment unit, an image processing unit, and a digital-to-analog converter is disclosed. The judgment unit encodes a first input image to generate an encoded code and compares the encoded code with a preset code to generate a luminance controlling signal. The image processing unit processes an image signal by an algorithm and outputs the processed result when the judgment unit asserts the luminance controlling signal. The image processing unit directly outputs the image signal when the judgment unit un-asserts the luminance controlling signal. The digital-to-analog converter transforms the output of the image processing unit and outputs the transformed result to the pixels.

22 Claims, 10 Drawing Sheets

SOURCE DRIVER AND ELECTRONIC SYSTEM UTILIZING THE SAME

CROSS REFERENCE TO RELATED APPLICATIONS

This application claims priority of Taiwan Patent Application No. 98110375, filed on Mar. 30, 2009, the entirety of which is incorporated by reference herein.

BACKGROUND OF THE INVENTION

1. Field of the Invention

The invention relates to an electronic system, and more particularly to an electronic system with a display panel.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays.

Generally, flat-panel displays comprise self-luminescence displays and non-self-luminescence displays. Liquid crystal displays (LCD) are the self-luminescence displays. The self-luminescence displays comprise plasma display panels (PDP), field emission displays (FED), and electroluminescent (EL) displays and organic light emitting diode (OLED) displays.

The self-luminescence displays are widely used as they possess the favorable advantages of thin profile, light weight, high luminance efficiency and low driving voltage. However, when the self-luminescence display displays the same image for a long period of time, the lifespan of the luminiferous elements are reduced. Taking a mobile phone as an example, a display image is shown in FIG. 1. The regions 110 and 130 continuously display the same image. Thus, the lifespan of the pixels disposed in the regions 110 and 130 are reduced because an image sticking effect occurs in the regions 110 and 130.

BRIEF SUMMARY OF THE INVENTION

Source drivers are provided. An exemplary embodiment of a source driver provides an output image to a plurality of pixels and comprises a judgment unit, an image processing unit, and a digital-to-analog converter. The judgment unit encodes a first input image to generate an encoded code and compares the encoded code with a preset code to generate a luminance controlling signal. The image processing unit processes an image signal by an algorithm and outputs the processed result when the judgment unit asserts the luminance controlling signal. The image processing unit directly outputs the image signal when the judgment unit un-asserts the luminance controlling signal. The digital-to-analog converter transforms the output of the image processing unit and outputs the transformed result to the pixels.

Electronic systems are also provided. An exemplary embodiment of an electronic system comprises a power supply and a display panel. The power supply provides an operation voltage. The display panel receives the operation voltage and comprises a gate driver, a plurality of pixels, and a source driver. The gate driver provides a plurality scan signals. The pixels receive the scan signals. The source driver provides an output signal to the pixels and comprises a judgment unit, an image processing unit, and a digital-to-analog converter. The judgment unit encodes a first input image to generate an encoded code and compares the encoded code with a preset code to generate a luminance controlling signal. The image processing unit processes an image signal by an algorithm and outputs the processed result when the judgment unit asserts the luminance controlling signal. The image processing unit directly outputs the image signal when the judgment unit un-asserts the luminance controlling signal. The digital-to-analog converter transforms the output of the image processing unit and outputs the transformed result to the pixels.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 2:
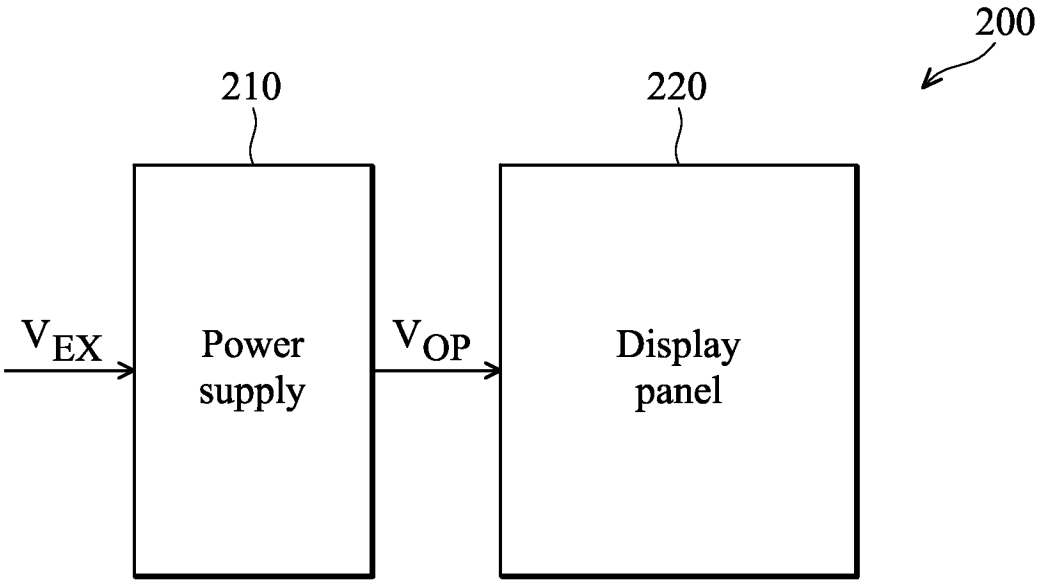
FIG. 2 is a schematic diagram of an exemplary embodiment of an electronic system.

FIG. 2 is a schematic diagram of an exemplary embodiment of an electronic system. In this embodiment, the electronic system 200 can be a personal digital assistant (PDA), a mobile phone, a digital camera, a television, a global positioning system (GPS), a car display, an avionics display, a digital photo frame, a notebook computer (NB), or a personal computer (PC).

The electronic system 200 comprises a power supply 210 and a display panel 220. The power supply 210 provides an operation voltage $V_{OP}$. In one embodiment, the power supply 210 is a battery module. In other embodiments, the power supply 210 has a transforming function for transforming an external power $V_{EX}$ into the operation voltage $V_{OP}$, wherein the external power $V_{EX}$ is an alternating current (AC) signal and the operation voltage $V_{OP}$ is a direct current (DC) signal.

Figure 3:
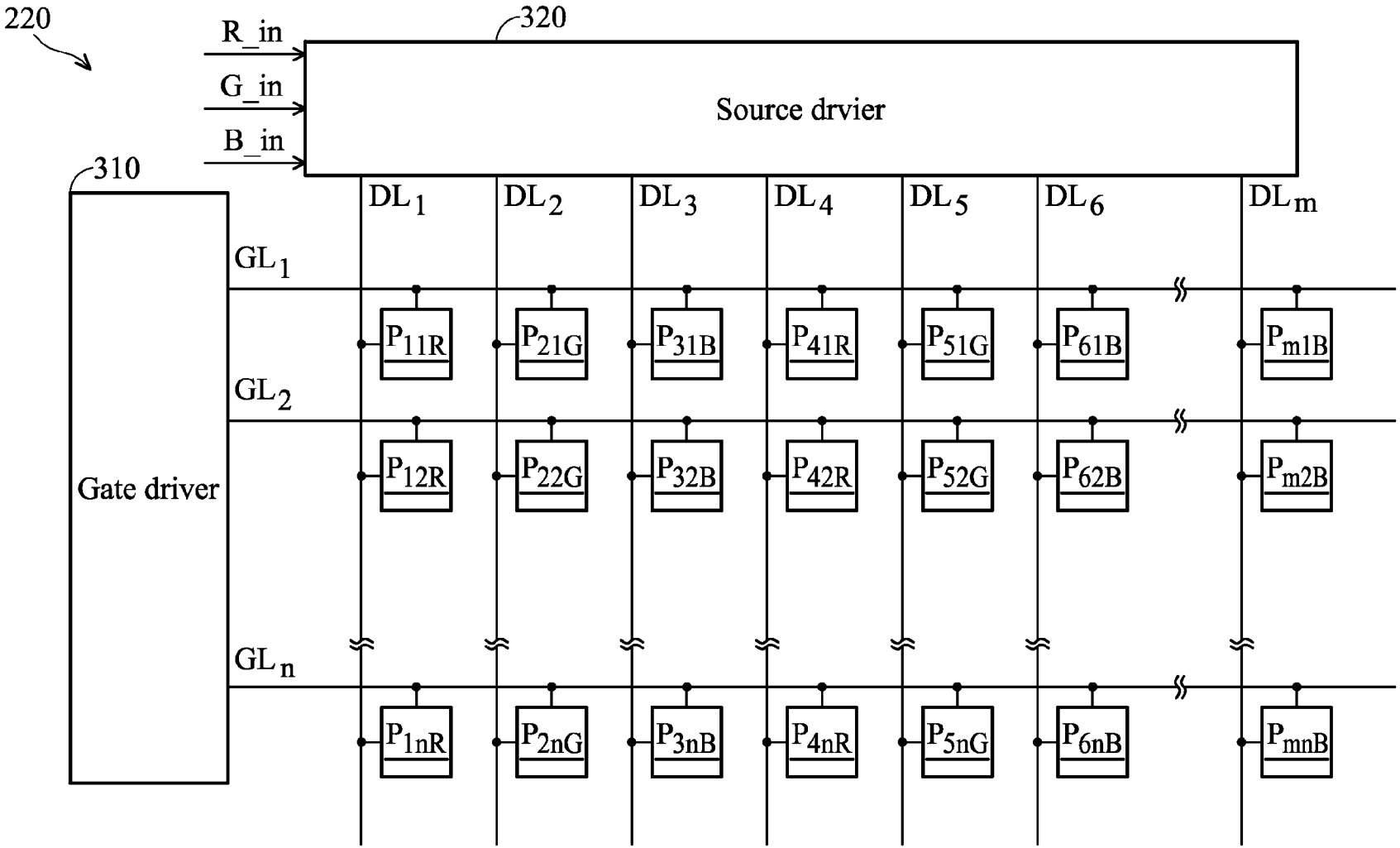
FIG. 3 is a schematic diagram of an exemplary embodiment of a display panel.

The display panel 220 receives the operation voltage $V_{OP}$ and displays an image. FIG. 3 is a schematic diagram of an exemplary embodiment of a display panel. The display panel 220 comprises a gate driver 310, a source driver 320, and pixels $P_{11R}$~$P_{mnB}$. The gate driver 310 transmits scan signals to the pixels $P_{11R}$~$P_{mnB}$ via the gate lines $GL_1$~$GL_n$. The source driver 320 generates an output image according to input images R_in, G_in, and B_in and transmits the output image to the pixels $P_{11R}$~$P_{mnB}$ via data lines $DL_1$~$DL_m$. The pixels $P_{11R}$~$P_{mnB}$ receives the output image according to the scan signals and display the corresponding brightness according to the output image. To display brightness, each of the pixels $P_{11R}$~$P_{mnB}$ comprises a luminiferous element. The luminiferous element may be a light emitter diode (LED) or an organic light emitter diode (OLED).

In this embodiment, the pixels coupled to the same data line display the same color. For example, the pixels $P_{11R}$~$P_{1nR}$ are coupled to the data line $DL_1$ and display red color. In addition, the pixels coupled to the same gate line successively display red color, green color, and blue color. For example, the pixels $P_{11R}$, $P_{21G}$, and $P_{31B}$ are coupled to the gate line $GL_1$ and the pixel $P_{11R}$ displays the red color, the pixel $P_{21G}$ displays the green color, and the pixel $P_{31B}$ displays the blue color. Similarly, the pixels $P_{41R}$, $P_{51G}$, and $P_{61B}$ are coupled to the gate line $GL_1$, and the pixel $P_{41R}$ displays the red color, the pixel $P_{51G}$ displays the green color, and the pixel $P_{61B}$ displays the blue color. The invention does not limit the displayed color. In some embodiments, the pixels coupled to the same gate line can successively or not successively display a red color, a green color, a blue color, and a white color.

Figure 4A:
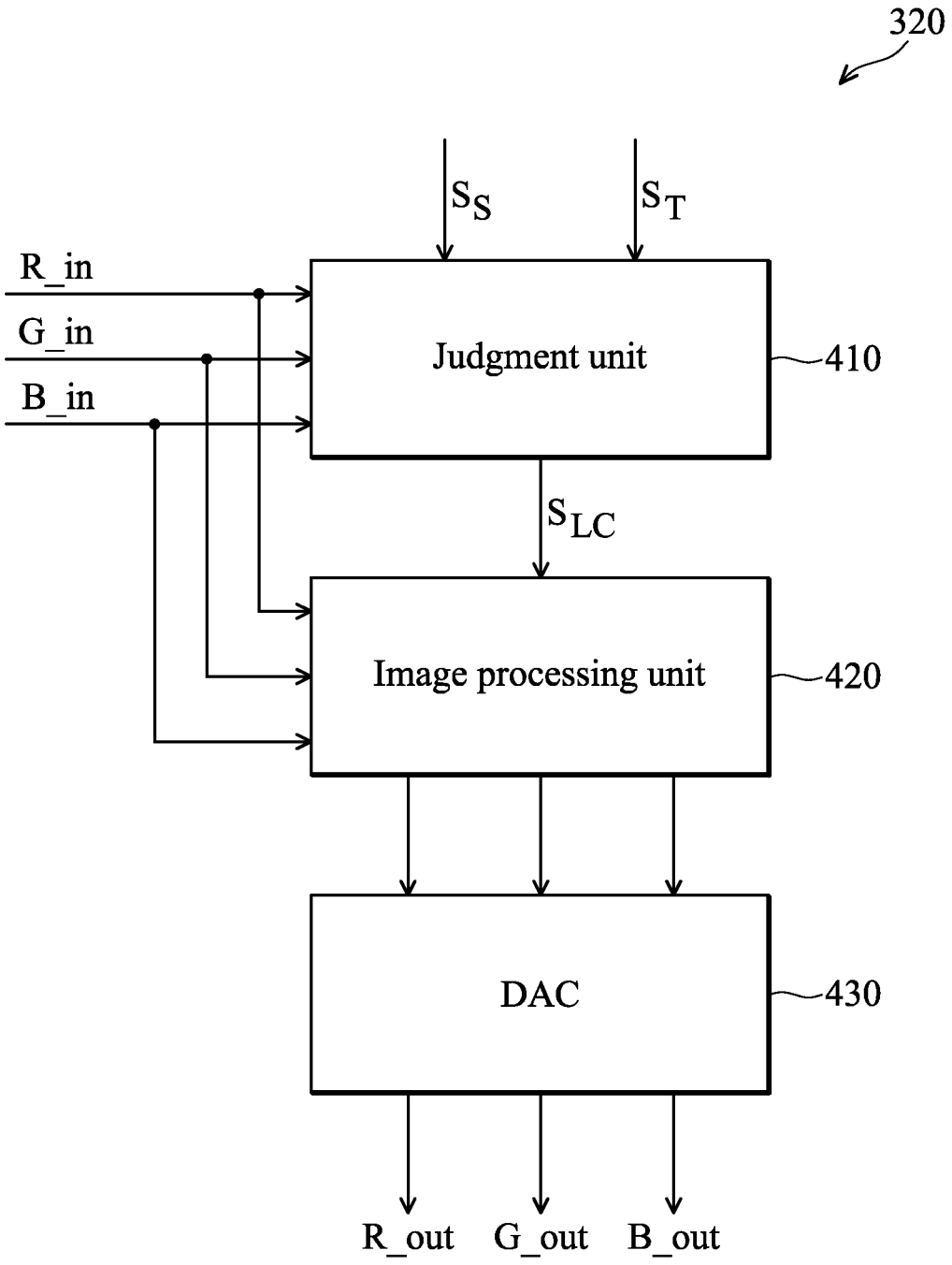
FIG. 4A is a schematic diagram of an exemplary embodiment of a source driver.

Furthermore, the source driver 320 has a function for determining still images to avoid the pixels $P_{11R}$~$P_{mnB}$ to display the same image for a long period of time. When the input images R_in, G_in, and B_in constitute a still image, the source driver 320 appropriately adjusts the input images R_in, G_in, and B_in and then provides the adjusted images to the pixels $P_{11R}$~$P_{mnB}$. FIG. 4A is a schematic diagram of an exemplary embodiment of a source driver. The source driver 320 comprises a judgment unit 410, an image processing unit 420, and a digital-to-analog converter (DAC) 430.

The judgment unit 410 encodes the input images R_in, G_in, and B_in to generate an encoded code and then compares the encoded code and a preset code to determine whether the input images R_in, G_in, and B_in constitute a still image and generates a luminance controlling signal $S_{LC}$. In one embodiment, the judgment unit 410 encodes other input images to generate the preset code, wherein the procedure of encoding other input images is the same as the procedure of encoding the input images R_in, G_in, and B_in. For example, before encoding the input images R_in, G_in, and B_in, the judgment unit 410 encodes a pre-input image and then utilizes the encoded result as a preset code for comparing the input images R_in, G_in, and B_in.

In other embodiments, before encoding the input images R_in, G_in, and B_in, the judgment unit 410 encodes a plurality of input images and determines whether the plurality of input images constitute still images according to the encoded result.

Assume a first input image, a second input image, and a third input image are successive images. The judgment unit 410 encodes the first input image to generate a first encoded result, encodes the second input image to generate a second encoded result, and encodes the third input image to generate a third encoded result. When the first and the second encoded results are the same, the judgment unit 410 adds a preset value with 1, wherein the original preset value is 0. When the second and the third encoded results are the same, the judgment unit 410 adds the preset value with 1. When the second and the third encoded results are different, the judgment unit 410 resets the preset value to 0.

The invention does not limit the number of compared encoded results. In one embodiment, the judgment unit 410 compares two successive encoded results. In another embodiment, the judgment unit 410 compares at least three successive encoded results.

When the judgment unit 410 encodes a plurality of pre-input images, a plurality of encoded results are obtained. The encoded results are utilized to determine whether the present input images R_in, G_in, and B_in constitute a still image. If the present input images R_in, G_in, and B_in constitute a still images and a specific condition is satisfied, the luminance controlling signal $S_{LC}$ is asserted. A more detailed description follows.

Since the input images R_in, G_in, and B_in are encoded by the judgment unit 410, the source driver 320 does not require a frame memory to store input images. In this embodiment, the judgment unit 410 is utilized to compare the encoded results. Before a still image is determined, it is not required to process the input images R_in, G_in, and B_in provided to the source driver 320. Thus, the image processing unit 420 is in a standby mode to save power consumption.

In this embodiment, the judgment unit 410 generates a luminance controlling signal $S_{LC}$ according to the compared result. In other embodiments, the judgment unit 410 encodes the input images R_in, G_in, and B_in according to a specific condition, such as a setting signal $S_S$ and/or a timing signal $S_T$. The setting signal $S_S$ and the timing signal $S_T$ are described in the following.

The image processing unit 420 determines whether to execute an algorithm for an image signal according to the luminance controlling signal $S_{LC}$. When the judgment unit 410 asserts the luminance controlling signal $S_{LC}$ (i.e. the input images R_in, G_in, and B_in constitute a still image), the image processing unit 420 processes an image signal by an algorithm and outputs the processed result. In this embodiment, the image signal is the input images R_in, G_in, and B_in. When the judgment unit 410 un-asserts the luminance controlling signal $S_{LC}$ (i.e. the input images R_in, G_in, and B_in do not constitute a still image), the image processing unit 420 does not process the image signal and directly outputs the image signal.

The algorithm is to reduce brightness of pixels or utilize the idle pixels to share brightness. For example, assume a pixel displaying a still image is referred to as a main pixel. After the algorithm, the brightness of the main pixel is reduced or the brightness of the main pixel is reduced and the neighboring pixels thereof are enhanced.

The algorithm comprises a blurring algorithm, a color saturation algorithm, a brightness algorithm, a shifting algorithm, or a combination of the blurring algorithm, the color saturation algorithm, the brightness algorithm, and the shifting algorithm, but is not limited. Those skilled in the art can utilize other algorithms to process the brightness of the main pixel.

Figure 5A:
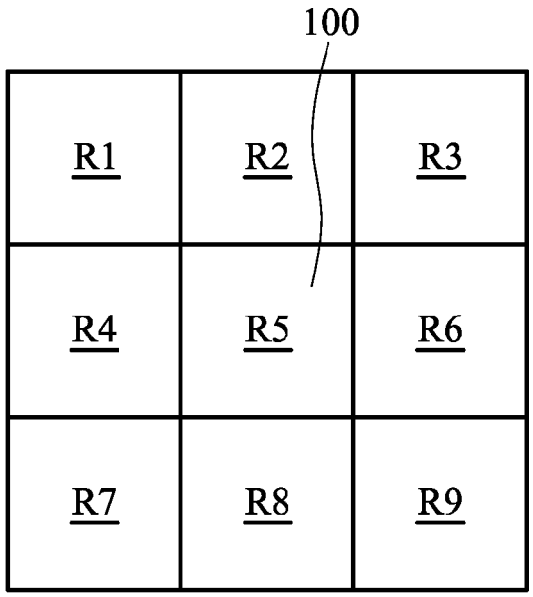
FIGS. 5A~8B are schematic diagrams of gray levels of successive images.
Figure 5B:
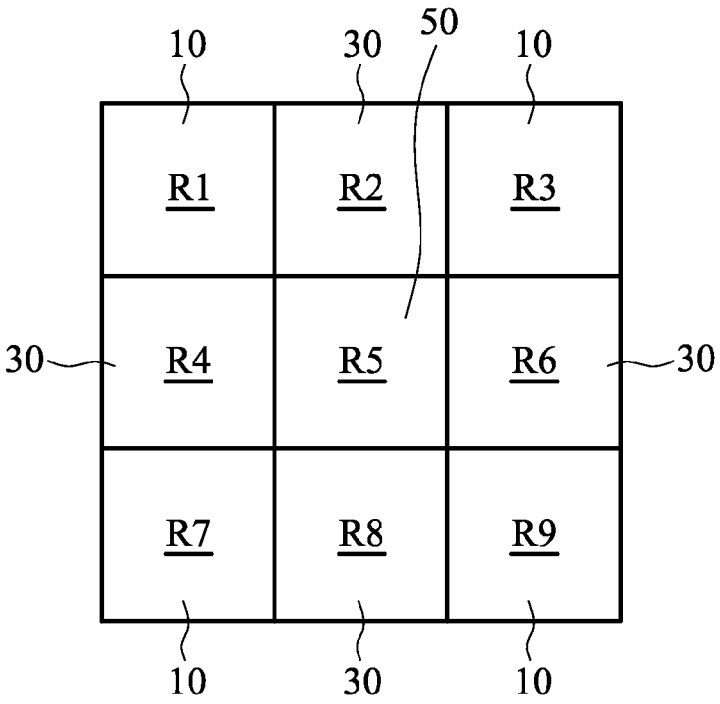

FIGS. 5A and 5B are schematic diagrams of gray level of successive images. Assume FIGS. 5A and 5B display a still image. In FIG. 5A, the gray level of the region R5 is 100 and others are 0. After the blurring algorithm, the gray level of the region R5 is changed from 100 to 50, the gray level of the regions R1, R3, R7, R9 are changed from 0 to 10, and the gray level of the regions R2, R4, R6, R8 are changed from 0 to 30 as shown in FIG. 5B. Since the brightness of the region R5 is reduced, the lifespan of the pixel disposed in the region R5 is increased.

Figure 6A:
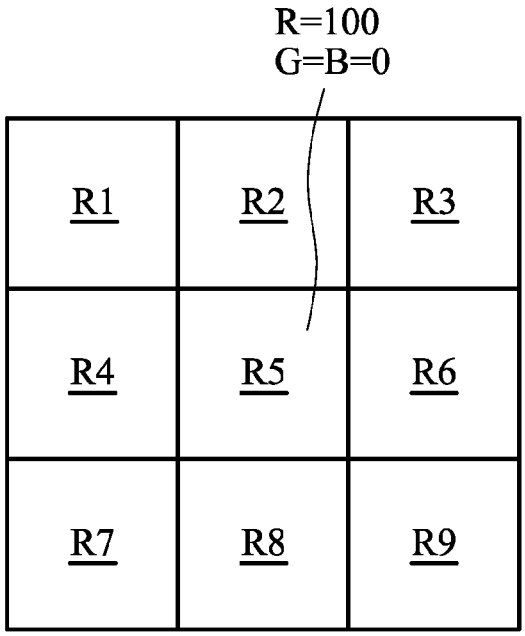
Figure 6B:
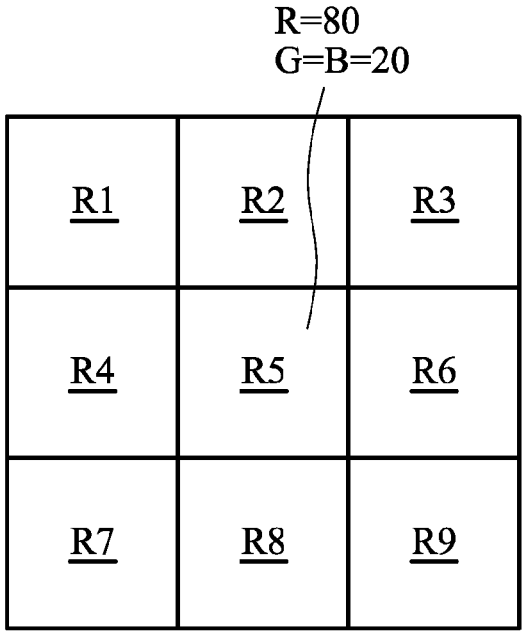

FIGS. 6A and 6B are schematic diagrams of gray level of successive images. Assume FIGS. 6A and 6B display a still image. In FIG. 6A, the gray levels of pixels R, G, B disposed in the region R5 are 100, 0, 0. After the color saturation algorithm, the gray levels of pixels R, G, B are changed to 80, 20, 20 as shown in FIG. 6B. In this embodiment, the idle pixels are utilized to share the brightness of the busy pixel.

Figure 7A:
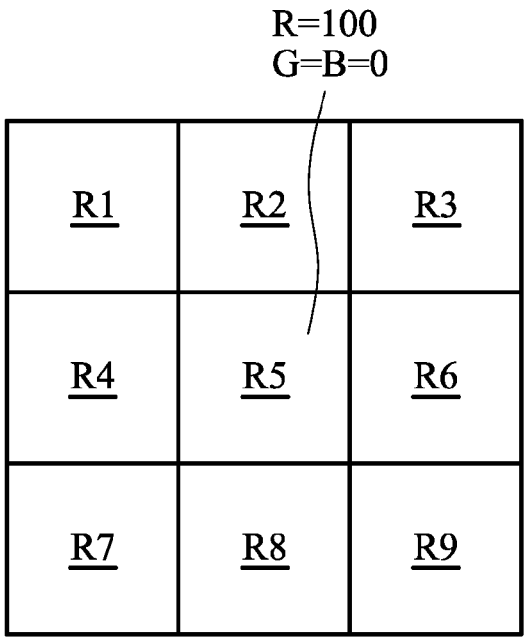
Figure 7B:
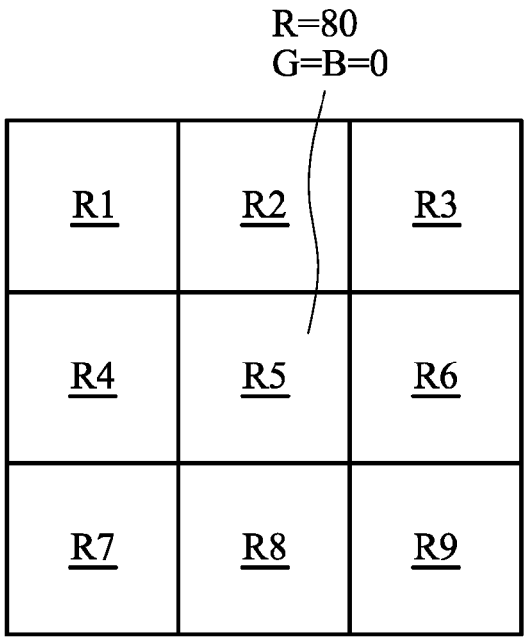

FIGS. 7A and 7B are schematic diagrams of gray level of successive images. Assume FIGS. 7A and 7B display a still image. In FIG. 7A, the gray levels of pixels R, G, B disposed in the region R5 are 100, 0, 0. After the brightness algorithm, the gray levels of pixels R, G, B are changed to 80, 0, 0 as shown in FIG. 7B. In this embodiment, the brightness of the busy pixel is reduced.

Figure 8A:
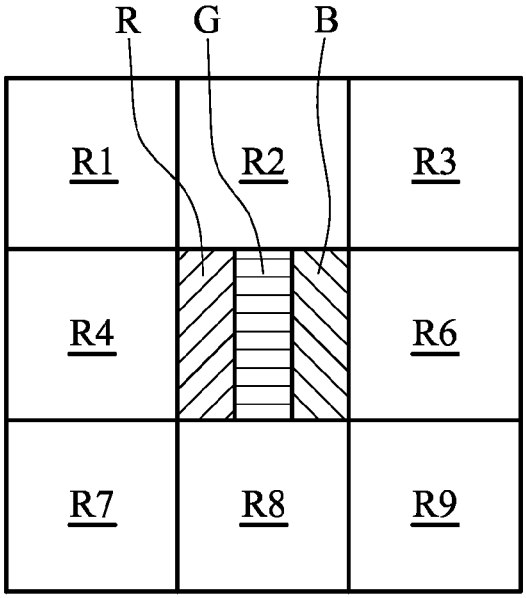
Figure 8B:
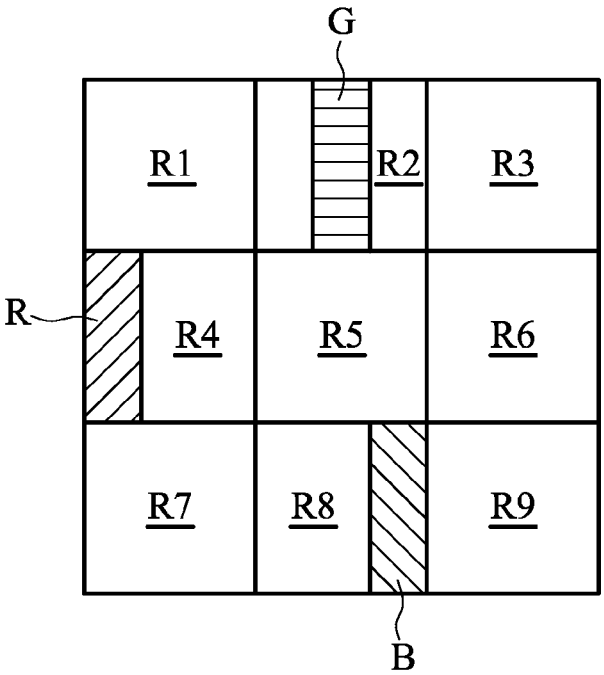

FIGS. 8A and 8B are schematic diagrams of gray level of successive images. Assume FIGS. 8A and 8B display a still image. In FIG. 8A, the pixels R, G, B disposed in the region R5 are enhanced. After the shifting algorithm, the pixel G disposed in the region R2, the pixel R disposed in the region R4, and the pixel B disposed in the region R8 are enhanced as shown in FIG. 8B. In this embodiment, the idle pixels disposed the different regions share the brightness of the busy pixel.

Generally, the lifespan of the pixel displaying the blue color is shorter than the lifespan of the pixel displaying the red color or the green color. Thus, the pixel having a longer lifespan is utilized to share the brightness of the pixel having a shorter lifespan. For example, if the brightness of pixel displaying the blue color is 100. After the algorithm, the brightness of pixel displaying the blue color is changed from 100 to 80 and the brightness of pixel displaying the red or the green color is 20. Further, the brightness of pixel displaying the white color is increased and the brightness of pixel displaying the blue or the red color is reduced to increase the lifespan of the pixels.

In FIG. 4A, the digital-to-analog converter 430 provides the output images R_out, G_out, and B_out to pixels $P_{11R}$~$P_{mnB}$ according to the output of the image processing unit 420. The inputted images from the digital-to-analog converter 430 are processed by the algorithm to avoid the pixel to display the same image for a long period of time. In this embodiment, the digital-to-analog converter 430 transforms the output of the image processing unit 420 from a digital form to an analog form.

Figure 4B:
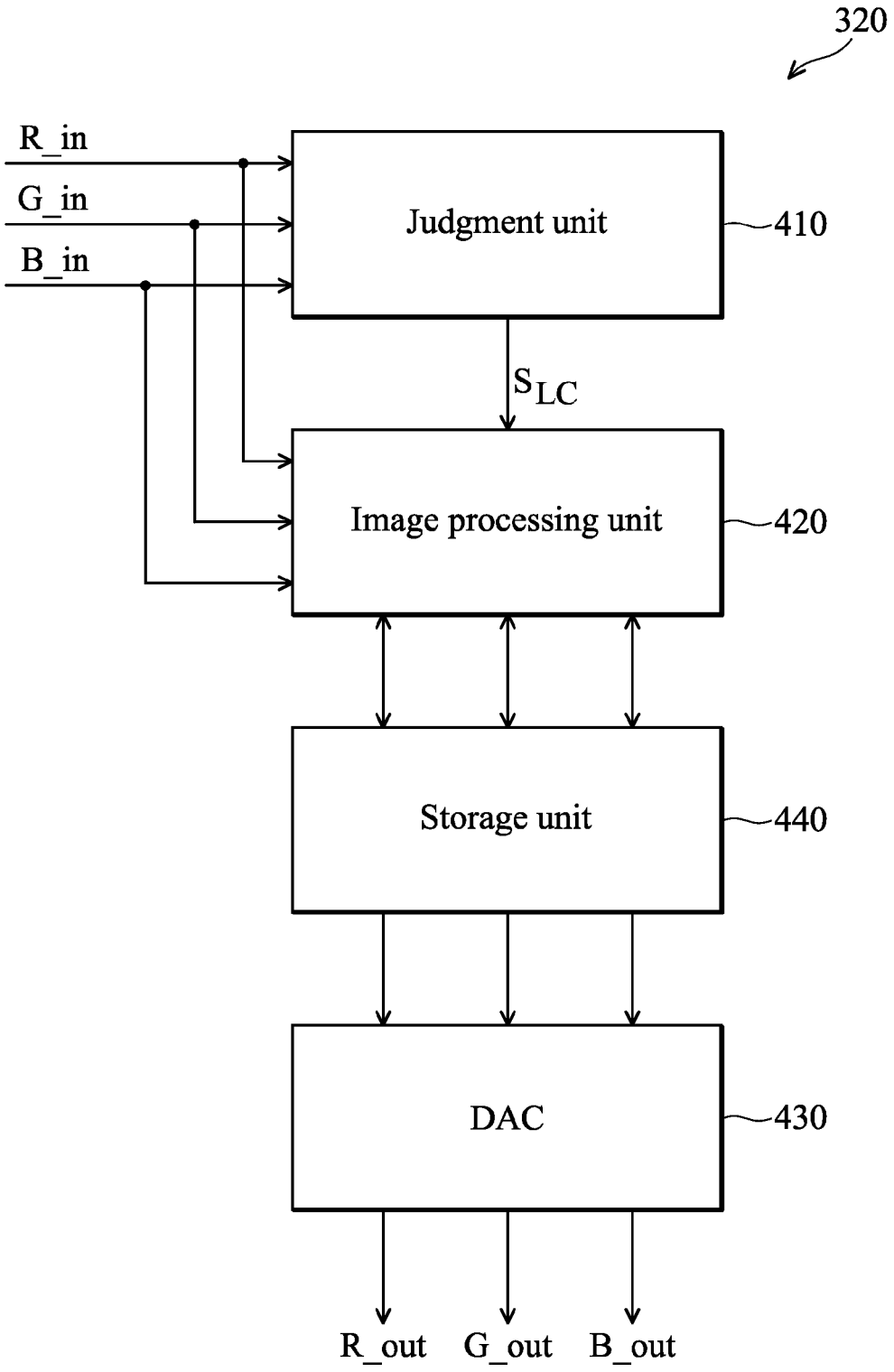
FIG. 4B is a schematic diagram of another exemplary embodiment of a source driver.

FIG. 4B is a schematic diagram of another exemplary embodiment of a source driver. FIG. 4B is similar to FIG. 4A except for the addition of the storage unit 440. In this embodiment, the storage unit 440 stores the processed image signal processed by the image processing unit 420. When the luminance controlling signal $S_{LC}$ is asserted in a following attempt, the image processing unit 420 processes the stored image stored in the storage unit 440 to increase the processing level.

For example, assume the image processing unit 420 executes a blurring algorithm for an image signal and the storage unit 440 stores the processed result of the image processing unit 420. When the luminance controlling signal $S_{LC}$ is asserted in a following attempt, the image processing unit 420 executes the blurring algorithm for the pre-processed result stored in the storage unit 440. Thus the blurring level is increased. Then, the data stored in the storage unit 440 is updated. In addition, the digital-to-analog converter 430 generates the output images R_out, G_out, and B_out according to the stored data.

Figure 9:
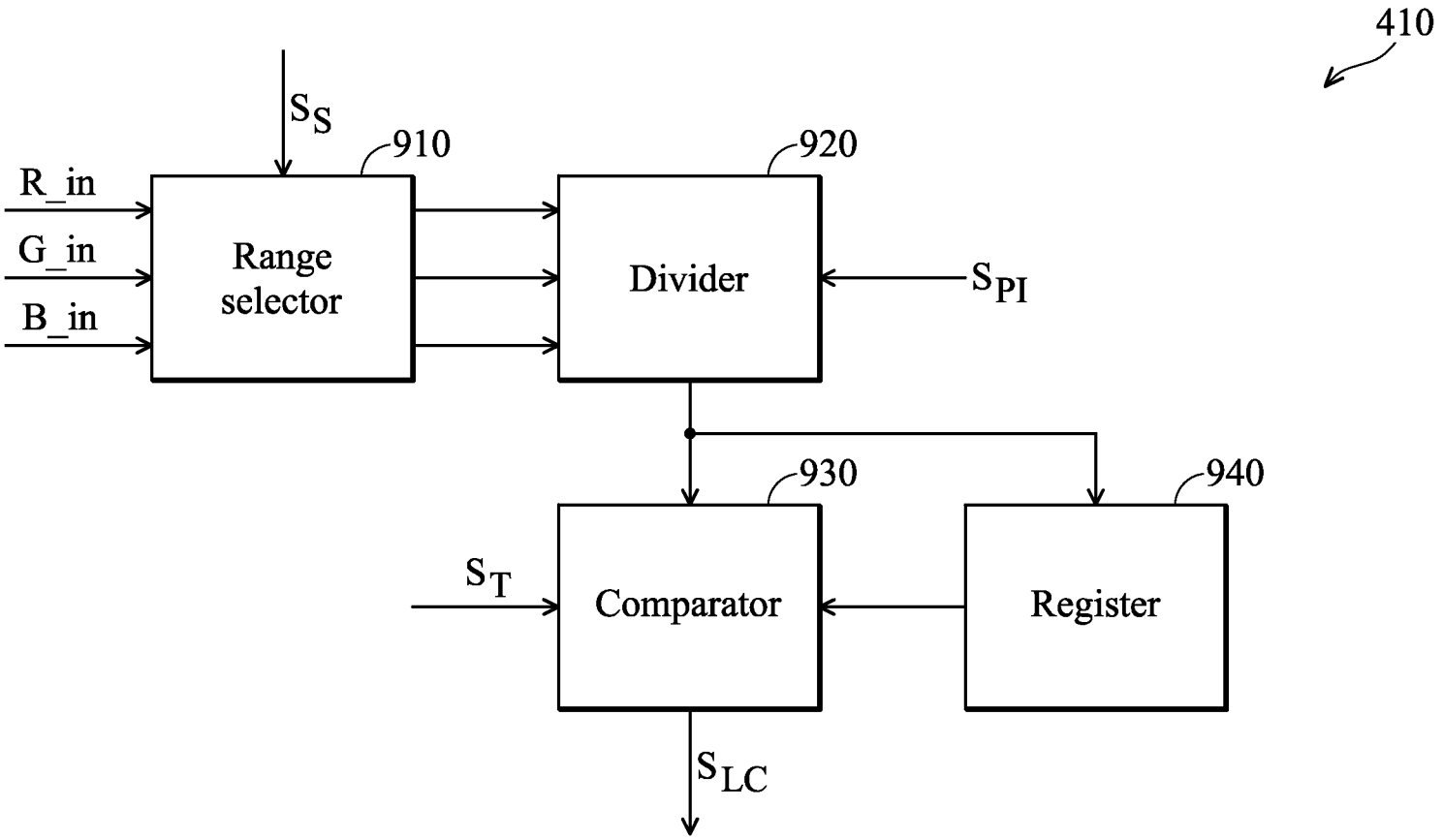
FIG. 9 is a schematic diagram of an exemplary embodiment of a judgment unit.

FIG. 9 is a schematic diagram of an exemplary embodiment of a judgment unit. The judgment unit 410 comprises a range selector 910, a divider 920, a comparator 930, and a register 940. The range selector 910 selectively transmits all of the input images R_in, G_in, and B_in or transmits a portion of the input images R_in, G_in, and B_in to the divider 920 according to the setting signal $S_S$.

Figure 1:
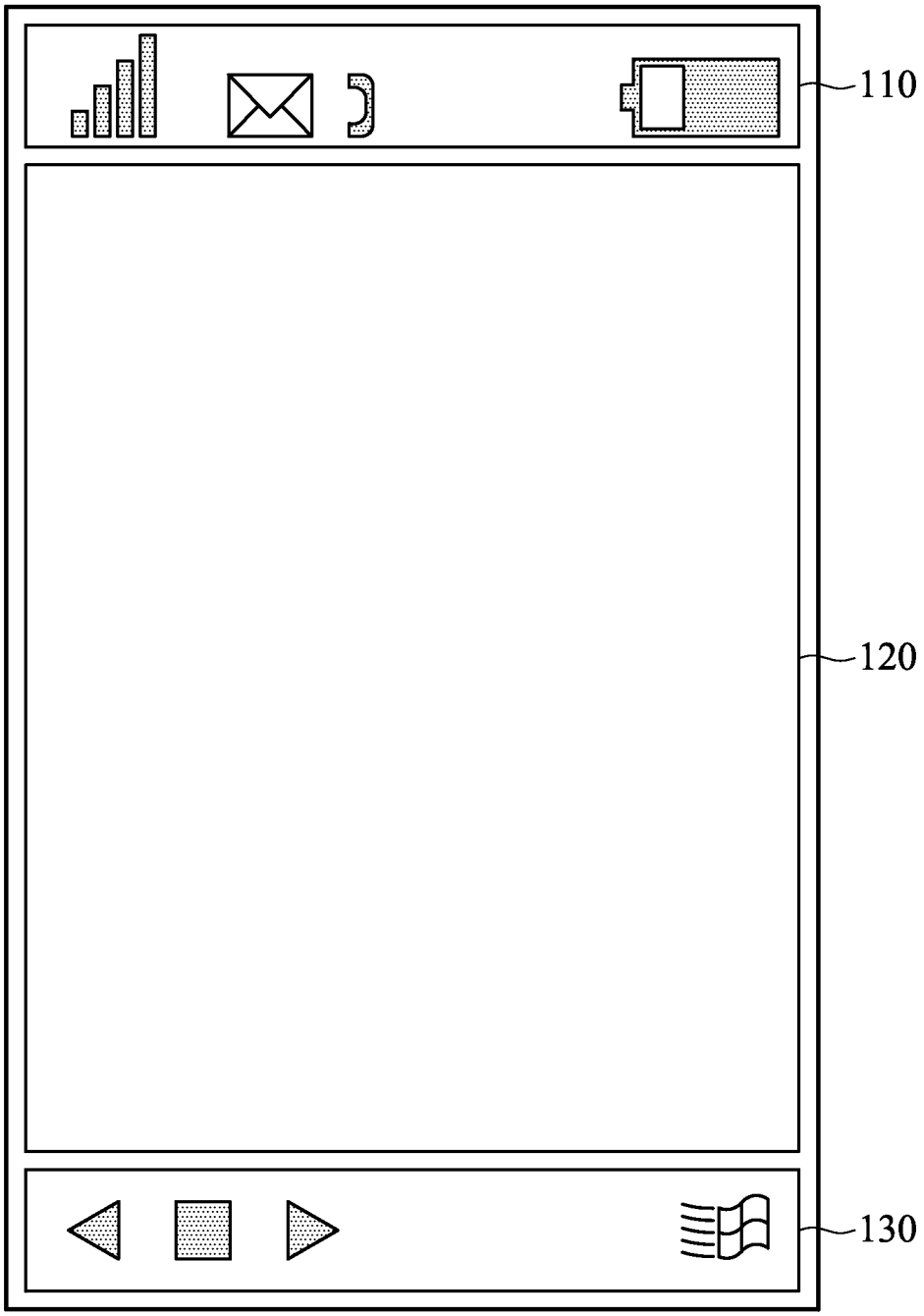
FIG. 1 shows an image of a mobile phone.

For example, assume the pixels disposed in the regions 110 and 130 shown in FIG. 1 display still images. The range selector 910 only transmits the images of the regions 110 and 130 to the divider 920. In other embodiments, if all input images R_in, G_in, and B_in are required to determine whether to constitute a still image, the range selector 910 can be omitted and the input images R_in, G_in, and B_in are directly transmitted to the divider 920.

The divider 920 calculates a preset input signal $S_{P1}$ and the output of the range selector 910 by a long division operation, but is not limited. Those skilled in the art can utilize other operations to encode or calculate the input images R_in, G_in, and B_in. In one embodiment, the divider 920 calculates the input images R_in, G_in, and B_in for an XOR operation.

The comparator 930 compares the calculated result of the divider 920 and the data stored in the register 940 and generates the luminance controlling signal $S_{LC}$ according to the compared result. After the calculated result of the divider 920 and the data stored in the register 940 are compared, the register 940 stores the calculated result of the divider 920. In other embodiments, when the number of compared results exceeds a preset value, the comparator 930 generates the luminance controlling signal $S_{LC}$ according to the timing signal $S_T$.

In one embodiment, a specific condition is satisfied when all of the input images R_in, G_in, and B_in have been determined whether they constitute a still image and the number of compared results is less than a preset value. On the other hand, when the encoded code corresponds to the preset code, the judgment unit 410 decides whether to assert the luminance controlling signal $S_{LC}$ according to the setting signal $S_S$ and the timing signal $S_T$.

For example, if the setting signal $S_S$ and the timing signal $S_T$ are omitted (i.e. the specific condition is satisfied), when the encoded code corresponds to the preset code, the luminance controlling signal $S_{LC}$ is asserted. If the setting signal $S_S$ or the timing signal $S_T$ is not omitted, when the encoded code corresponds to the preset code, the judgment unit 410 must accord to the setting signal $S_S$ or the timing signal to determine whether to assert the luminance controlling signal $S_{LC}$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A source driver providing an output image to a plurality of pixels, comprising:

a judgment unit encoding a first input image to generate an encoded code and comparing the encoded code with a preset code to generate a luminance controlling signal;

an image processing unit processing an image signal by an algorithm and outputting a processed result when the judgment unit asserts the luminance controlling signal and directly outputting the image signal when the judgment unit un-asserts the luminance controlling signal; and a digital-to-analog converter transforming the output of the image processing unit and outputting a transformed result to the pixels, wherein before the judgment unit encodes the first input image, the judgment unit encodes at least one pre-input image to generate the preset code.

2. The source driver as claimed in claim 1, wherein the judgment unit encodes the first input image by an XOR operation.

3. The source driver as claimed in claim 1, wherein the judgment unit encodes a portion of the first input image according to a setting signal.

4. The source driver as claimed in claim 1, wherein the image signal is the first input image.

5. The source driver as claimed in claim 1, further comprising a storage unit storing a processed image, wherein the processed image is the processed result of the image processing unit.

6. The source driver as claimed in claim 5, wherein the processed image serves as the image signal when the judgment unit asserts the luminance controlling signal in a following attempt.

7. The source driver as claimed in claim 1, wherein the algorithm is a blurring algorithm, a color saturation algorithm, a brightness algorithm, or a shifting algorithm.

8. The source driver as claimed in claim 1, wherein the judgment unit further encodes a first pre-input image to generate a first encoded result, generates the preset code according to the first encoded result, and the judgment unit encodes the first pre-input image and then encodes the first input image.

9. The source driver as claimed in claim 8, wherein the judgment unit further encodes a second pre-input image to generate a second encoded result, compares the first and the second encoded results to generate the preset code, and the judgment unit encodes the second pre-input image and then encodes the first pre-input image and finally encodes the first input image.

10. An electronic system comprising:

a power supply providing an operation voltage; and a display panel receiving the operation voltage, and comprising:

a gate driver providing a plurality scan signals;

a plurality of pixels receiving the scan signals; and a source driver providing an output signal to the pixels and comprising:

a judgment unit encoding a first input image to generate an encoded code and comparing the encoded code with a preset code to generate a luminance controlling signal;

an image processing unit processing an image signal by an algorithm and outputting a processed result when the judgment unit asserts the luminance controlling signal and directly outputting the image signal when the judgment unit un-asserts the luminance controlling signal; and a digital-to-analog converter transforming the output of the image processing unit and outputting a transformed result to the pixels, wherein before the judgment unit encodes the first input image, the judgment unit encodes at least one pre-input image to generate the preset code.

11. The electronic system as claimed in claim 10, wherein the judgment unit encodes the first input image by an XOR operation.

12. The electronic system as claimed in claim 10, wherein the judgment unit encodes a portion of the first input image according to a setting signal.

13. The electronic system as claimed in claim 10, wherein the image signal is the first input image.

14. The electronic system as claimed in claim 10, further comprising a storage unit storing a processed image, wherein the processed image is the processed result of the image processing unit.

15. The electronic system as claimed in claim 14, wherein the processed image serves as the image signal when the judgment unit asserts the luminance controlling signal in a following attempt.

16. The electronic system as claimed in claim 10, wherein the algorithm is a blurring algorithm, a color saturation algorithm, a brightness algorithm, or a shifting algorithm.

17. The electronic system as claimed in claim 10, wherein the judgment unit further encodes a first pre-input image to generate a first encoded result, generates the preset code according to the first encoded result, and the judgment unit encodes the first pre-input image and then encodes the first input image.

18. The electronic system as claimed in claim 17, wherein the judgment unit further encodes a second pre-input image to generate a second encoded result, compares the first and the second encoded results to generate the preset code, and the judgment unit encodes the second pre-input image and then encodes the first pre-input image and finally encodes the first input image.

19. The electronic system as claimed in claim 17, wherein each pixel comprises a luminiferous element.

20. The electronic system as claimed in claim 17, wherein each luminiferous element is a light emitter diode (LED) or an organic light emitter diode (OLED).

21. The electronic system as claimed in claim 17, wherein the electronic system is a personal digital assistant (PDA), a mobile phone, a digital camera, a television, a global positioning system (GPS), a car display, an avionics display, a digital photo frame, a notebook computer (NB), or a personal computer (PC).

22. The source driver as claimed in claim 1, wherein the judgment unit determines whether the first input image constitutes a still image according to the preset code.

* * * * *